US007510258B2

(12) United States Patent
Smink

(10) Patent No.: US 7,510,258 B2
(45) Date of Patent: Mar. 31, 2009

(54) METHOD OF DETECTING THE ALIGNMENT OF PRINTHEADS IN A PRINTER

(75) Inventor: Olav G. Smink, Tegelen (NL)

(73) Assignee: OCE-Technologies B.V., Venlo (NL)

( * ) Notice: Subject to any disclaimer, the term of this patent is extended or adjusted under 35 U.S.C. 154(b) by 339 days.

(21) Appl. No.: 11/580,864

(22) Filed: Oct. 16, 2006

(65) Prior Publication Data

US 2007/0085871 A1 Apr. 19, 2007

(30) Foreign Application Priority Data

Oct. 17, 2005 (EP) ..... 05109635

(51) Int. Cl.
*B41J 29/393* (2006.01)

(52) U.S. Cl. ..... 347/19; 347/5; 347/9

(58) Field of Classification Search ..... 347/5, 347/9, 12, 14, 19, 85, 86
See application file for complete search history.

(56) References Cited

U.S. PATENT DOCUMENTS

| | | | | |
|---|---|---|---|---|
| 4,590,482 | A * | 5/1986 | Hay et al. | 347/19 |
| 4,716,421 | A * | 12/1987 | Ozawa et al. | 347/14 |
| 4,941,405 | A | 7/1990 | Helms | |
| 6,371,591 | B1 | 4/2002 | Conta et al. | |
| 6,400,387 | B1 | 6/2002 | Kerr | |
| 6,498,685 | B1 | 12/2002 | Johnson | |
| 6,508,530 | B1 | 1/2003 | Conta et al. | |
| 2003/0085938 | A1 | 5/2003 | Imanaka et al. | |

FOREIGN PATENT DOCUMENTS

| | | | |
|---|---|---|---|
| EP | 0 965 894 | A1 | 12/1999 |
| WO | WO-01/62502 | A1 | 8/2001 |

* cited by examiner

*Primary Examiner*—Lam S Nguyen
(74) *Attorney, Agent, or Firm*—Birch, Stewart, Kolasch & Birch, LLP

(57) ABSTRACT

A method and system for detecting the alignment of print heads relative to one another in an ink jet printer having a plurality of print heads arranged side-by-side in a first direction (Y) on a carriage, each print head having a conductive nozzle plate which defines an edge that extends in said first direction (Y), wherein a sensor is used for determining the position of a reference mark formed on the print head, the sensor being used to measure the capacitance between the nozzle plate, serving as the reference mark, and the sensor, said alignment detection including the steps of moving the carriage) relative to the sensor in said first direction (Y) into a first position ("b") where said sensor) extends across the edge of one print head and a second position ("d") where the sensor extends across the edge) of another print head, measuring the capacitances in said first and second positions, and comparing the measured capacitances, thereby determining the relative position of said print heads in a second direction (X) orthogonal to said first direction (Y).

10 Claims, 2 Drawing Sheets

METHOD OF DETECTING THE ALIGNMENT OF PRINTHEADS IN A PRINTER

This application claims the priority benefit of European Patent Application No. 05109635.2 filed Oct. 17, 2005 which are hereby incorporated by reference.

BACKGROUND OF THE INVENTION

The present invention relates to a method of detecting the alignment of printheads relative to one another in an ink jet printer having a plurality of printheads arranged side-by-side in a first direction on a carriage, each print head having a conductive nozzle plate which defines an edge that extends in said first direction, wherein a sensor is used for determining the position of a reference mark formed on the print head. The present invention also relates to a printer for applying the present method.

A printer, e.g., an ink jet printer, comprises one or more print heads each of which carries an array of print elements, e.g., nozzles, for printing pixels on a sheet of a print substrate that is moved along a predetermined path relative to the print head. Typically, the print heads are mounted on a carriage that is moved across the path of the substrate in a main scanning direction Y, whereas the substrate is advanced in a sub-scanning direction X. The print elements or nozzles typically form a linear array that extends in X-direction.

In order to obtain a high quality of the printed image, the nozzles on the print heads must be positioned or positionable with high accuracy relative to the substrate. For example, in the typical set-up described above, the linear array of nozzles should form a specified angle with the main scanning direction Y, typically an angle of exactly 90°. Moreover, when a plurality of print heads are employed, for example, print heads for different colours, the print heads must be precisely aligned relative to one another in at least one direction, typically the sub-scanning direction X. In the other direction Y, it is at least required that the relative positions of the print heads and hence the nozzles are known with high accuracy, so that the individual print elements can be energised at correct timings in accordance with the image information.

A conventional method of detecting the alignment of the print heads consist of printing a test pattern which may then be inspected visually.

U.S. Pat. Nos. 6,371,591 B1 and 6,508,530 B1 disclose automatic detection methods of the type indicated above, utilising opto-electronic sensors.

U.S. Pat. No. 4,941,405 discloses a capacitive measurement of the position of the carriage in the main scanning direction, for controlling the timings at which the print elements are filed.

U.S. Pat. No. 6,498,685 discloses a capacitive system for detecting the two-dimensional alignment of a printhead (an optical exposure system) in a lithography system. Here, the individual printheads are aligned relative to the wafer which corresponds to the print substrate. The capacitive detection method relies upon a periodic pattern formed on the wafer.

US-A-2003 0 0085 938 discloses a capacitive measurement system for measuring an alignment of two substrates which, together, form the printhead. This system is used only when the printhead is assembled.

SUMMARY OF THE INVENTION

It is an object of the present invention to provide a method and printing system which permits detecting the alignment of print heads with high accuracy and which requires only a simple and robust hardware.

According to the present invention, a sensor is used to measure the capacitance between the nozzle plate, serving as the reference mark, and the sensor, and the alignment detection comprises the steps of moving the carriage relative to the sensor in a first direction into a first position where said sensor extends across said edge of one print head, and in a second position where said sensor extends across the edge of another print head; measuring the capacitances in said first and second positions, and comparing the measured capacitances, thereby determining the relative position of said print heads in a second direction orthogonal to said first direction.

It has been found that a capacitive position measurement permits a remarkably high detection accuracy with measurement errors being only in the sub-micrometer range, as is required for modern high-resolution printers. The present invention provides the advantage that the reference mark on the print head, which is usually installed on a moving carriage, can simply be formed by the conductive nozzle plate which has very little risk of being damaged mechanically and can easily be machined with high precision so as to have the correct positional relationship relative to the print elements. The nozzle plate has a straight edge extending at right angles to the direction in which the position measurement is to be performed and has a well defined positional relationship to the print elements. The sensor may simply be formed by another conductive plate which forms a capacitor together with the nozzle plate on the print head. The capacitance of this capacitor is proportional to the amount of overlap between the two plates and thus depends upon the relative position of the sensor and the print head. The capacitance measurement can be performed with high accuracy, for example by means of an oscillator circuit, the frequency of which is determined by the capacitance, as is generally known in the art of capacitive sensors.

The nozzle plate may have a rectangular cutout defining a straight edge, and the conductive plate of the sensor may have a rectangular shape and a size comparable to that of the cutout and may be arranged such that it overlaps with the cutout when the print head is in a predetermined position. Preferably, the sensor is stationary mounted in a predetermined position at a portion of the path of travel of the carriage where the carriage stops or moves with relatively low velocity, for example, in a cleaning section where the nozzle plates of the print heads are cleaned from time to time. Thus, sufficient time for performing a high precision capacitance measurements will be available.

Some ink jet printers have two or more print heads for the same color, e.g., black, and these print heads are arranged such that the nozzles thereof are staggered or offset relative to one another in the sub-scanning direction X. Then, the reference mark preferably has two straight edges that are offset by the same amount as the nozzles and are moved past the sensor one after the other, so that both offset positions can be measured independently from one another. Thus, the offset between the two print heads can be checked in a simple and reliable way when both print heads are equipped with identical nozzle plates.

When a conductive portion of the nozzle plate moves past the plate of the sensor, the capacitance will vary as a function of the position of the print head in the main scanning direction Y. The conductive plates may be arranged and configured such that the capacitance functions show at least one well defined peak, which permits detection of the position of the print head in the main scanning direction Y relative to the carriage, the position of which is monitored with an independent detection system. Such a detection system is required, anyway, for controlling the timings at which the print elements are energized. Thus, the invention provides a simple way of measuring the position of the print head in both the main scanning direction and the sub-scanning direction.

The inclination of the row of print elements relative to the sub-scanning direction X may be also detected, for example, by employing two sets of reference marks and sensors near opposite ends of each print head.

The reference marks and the sensor or sensors may permanently be integrated in the printer, whereas the electronic circuit needed for the capacitance measurements may either be integrated in the printer or may be formed by a separate unit that is electrically connected to the sensors and the conductive plates of the print heads only when the printer is being tested, e. g., in the manufacturing process or during maintenance or repair.

BRIEF DESCRIPTION OF THE DRAWINGS

Preferred embodiments of the present invention will now be described in conjunction with the drawings, wherein.

DETAILED DESCRIPTION OF THE INVENTION

Figure 1:
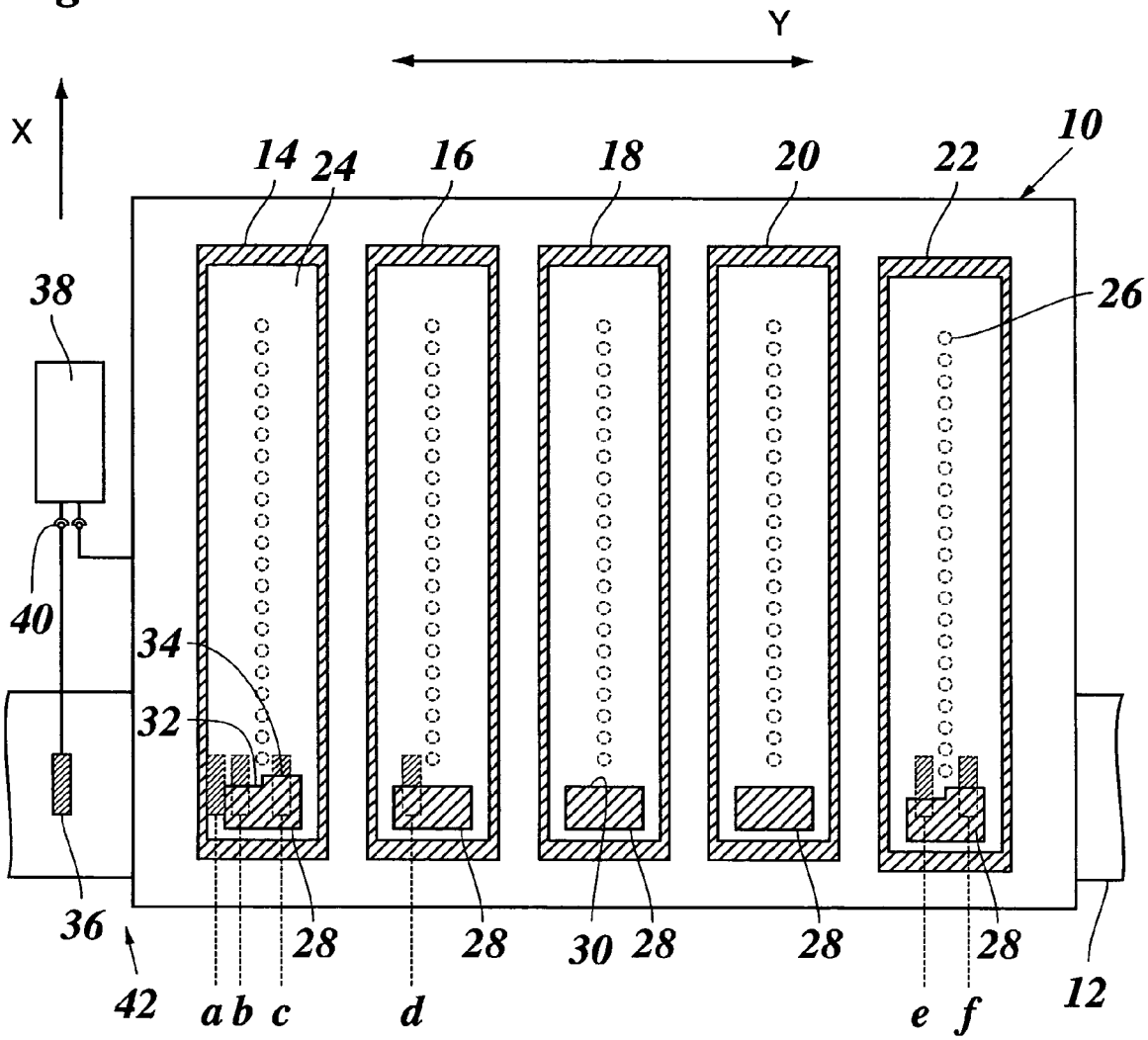
FIG. 1 is a schematic view of essential parts of a printer adapted to practice the method according to the invention.

As is shown in FIG. 1, an ink jet printer comprises a carriage 10 that is movable back and forth in a main scanning direction Y along a stationary frame 12. In the example shown, the carriage 10 carries five print heads 14, 16, 18, 20 and 22, among which the print heads 14 and 22 print with black ink, whereas the other print heads are provided for the colors, cyan, magenta and yellow. All five print heads have nozzle plates 24 which all have the same outer shape and each define a row of nozzles 26 serving as print elements. The rows of nozzles 26 extend in a sub-scanning direction X in which a sheet of a print substrate (not shown) is intermittently advanced relative to the frame 12 and the carriage. The print heads 14, 16, 18 and 20 are precisely aligned in the main scanning direction Y, so that their nozzles 26 have a well defined positional relationship in sub-scanning direction X, as is required for color printing.

The print head 22 is slightly offset from the other print heads in the sub-scanning direction X, so that the nozzles 26 of the print heads 14 and 22 are staggered, which enables the printing of black images with higher resolution.

The nozzle plates 24 are electrically conductive and serve to form reference marks for detecting or checking the alignment of the print heads. To this end, the nozzle plate 24 of each of the print heads 16, 18 and 20 has a rectangular cutout 28 defining an edge 30 that extends in the main scanning direction Y and is machined to have a well defined positional relationship to the nozzles 26 in sub-scanning direction X. The print heads 14 and 22 have similar cutouts 28 which, however have a stepped-shape so that they each define a first edge 32 and a second edge 34. The offset between these edges corresponds exactly to the offset between the print heads 14 and 22 in X-direction.

A sensor 36 is fixed relative to the frame 12 and has the form of an electrically conductive rectangular plate that is arranged in parallel with the nozzle plates 24 and forms a small clearance therewith when the carriage 10 and the print heads move past the sensor. Several possible positions of the sensor 36 relative to the nozzle plates 24 have been indicated in phantom lines in FIG. 1. The sensor 36 is arranged such that it extends over the edges 30, 32 and 34, so that a part of the sensor plate may overlap with the cutouts 28, whereas another part, which has been hatched in FIG. 1, overlaps with the nozzle plate 24 and forms a capacitance therewith. The capacitance of this capacitor is measured with a known measuring circuit 38 which, in the example shown, is adapted to be connected to the printer through a plug 40, so that it will be electrically connected to the sensor 36 on the one hand and to each of the nozzle plates 24 on the other hand. Although this has not been shown in detail in the drawing, the circuit 38 is selectively connectable to each of the nozzle plates 24. For example, the arrangement may be such that a specific nozzle plate 24 will be connected to the circuit 38 only in the condition where this nozzle plate is located in the vicinity of the sensor 36.

In practice, the frame 12 will be subdivided in an operating portion in which the carriage 10 moves back and forth when an image is being printed, and a cleaning station 42 which adjoins to one end of the operating portion and in which the sensor 36 is installed. Thus, the capacitance measurement can be performed when the carriage 10 stops in or is slowly moved through the cleaning station.

Figure 2:
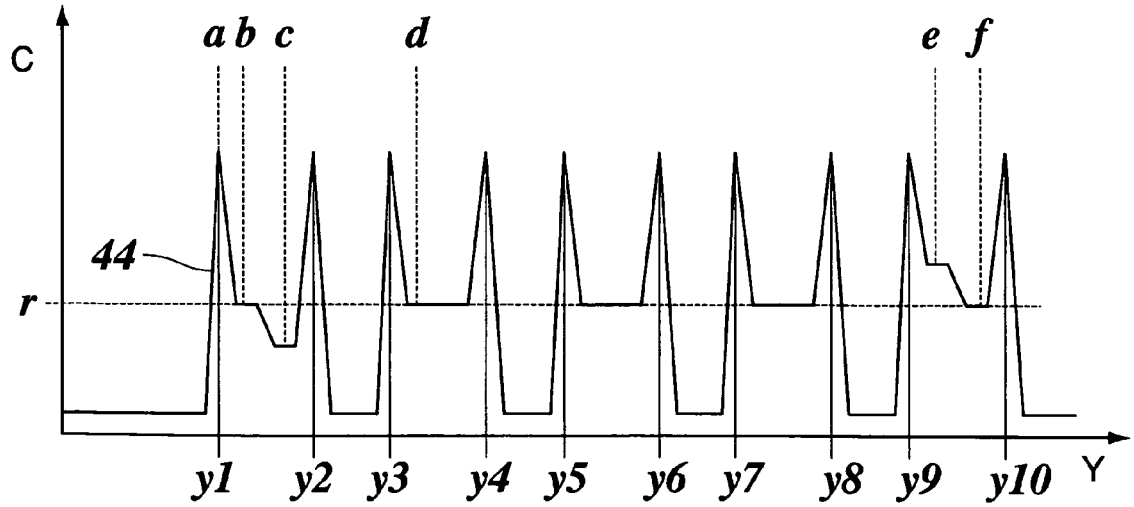
FIG. 2 is a capacitance position-diagram for the printer shown in FIG. 1.

As is generally known in the art of ink jet printers, a position measuring system (not shown) is provided for measuring and monitoring the position of the carriage 10 relative to the frame 12 in main scanning direction Y. The main function of this position measuring system is to determine the timing at which the nozzles 26 of the individual print heads have to be fired in order to form an image in accordance with the image information to be printed. In the present embodiment, the position measuring system also monitors the position of the carriage 10 when the same is in the cleaning station 42, and the results of the capacitance measurements performed with the circuit 38 are recorded as a function of the position of the carriage and may be plotted or displayed in the form of a diagram as shown in FIG. 2.

When the carriage 10 moves slowly to the left side in FIG. 1, the sensor 36 will first reach the position "a" relative to the carriage 10, as has been indicated in FIG. 1. The same position has also been designated as "a" in the diagram in FIG. 2. In this position, the plate of the sensor 36 fully overlaps with a rim of the nozzle plate 24 surrounding the cutout 28, so that the capacitance indicated by a curve 44 in FIG. 2 reaches a maximum and will show a pronounced peak. Then, when the cutout 28 starts to overlap with the sensor 36, the capacitance will decrease and will then remain on a stationary level while the edge 32 (position b) passes over the sensor. When the edge 34 is moved over the sensor, the capacitance will decrease again and will remain stationary for some time on a lower level, because the amount of overlap with the nozzle plate 24 has decreased (position c). When the carriage moves on, another peak in the capacitance curve will be found when the cutout 28 leaves the sensor, and the capacitance will drop to almost zero when the sensor is between the print heads 14 and 16.

A similar pattern is found when the print heads 16, 18 and 20 are moved past the sensor 36. However, since the cutouts 28 of these print heads have only a single straight edge 30, the capacitance will stay on a constant level while this edge (position d) is passed over the sensor. When the print heads 14 and 16 are aligned precisely, the edge 32 will be aligned exactly with the edge 30 of the print head 16, and this can be checked by confirming that the capacitance curve 44 for the positions "b" and "d" is exactly on the same level "r", as is shown in FIG. 2.

When the print heads 18 and 20 are moved over the sensor 36, the alignment of these print heads can be checked in the same way.

When the print head 22 reaches the position "e" over the sensor 36, the capacitance remains on a somewhat higher level, because the print head 22 is offset relative to the other print heads. However, when the position "f" is reached, this offset is compensated for by the offset between the edges 32 and 34 of the cutout 28 of the print head 22, so that the capacitance curve 44 again reaches the level r, which confirms that the offset position of the print head 22 has been adjusted correctly.

Thus, it can be confirmed in a simple measurement sequence that all the print heads are precisely adjusted in the sub-scanning direction X. Thanks to the stepped shape of the cutouts 28 of the nozzle plates of the print heads 14 and 22, identical nozzle plates may be used for these print heads, and it does not matter when the mounting positions of the print heads 14 and 22 are interchanged.

Of course, in a modified embodiment, the nozzle plates 24 of the print heads 16, 18 and 20 could have the same shape as those of the print heads 14 and 22, i. e., with a stepped cutout, so that the nozzle plates could be manufactured more efficiently.

A number of reference positions y1-y10 have been shown along the Y-axis in FIG. 2. By checking whether the peaks of the capacitance curve 44 coincide with these reference positions, it can be confirmed that the print heads 14-22 are also adjusted correctly in the main scanning direction Y. If any deviations should be found, it is not necessary mechanically to correct the positions of the print heads, but it is sufficient to appropriately adapt the timings at which the nozzles 26 are fired. An accurate detection of the positions of the print heads in Y-direction is facilitated by the fact that the width of the plate-like sensor 36 is equal to the width of the rim of the nozzle plates 24 surrounding the cutouts 28, so that sharp capacitance peaks are formed.

Figure 3:
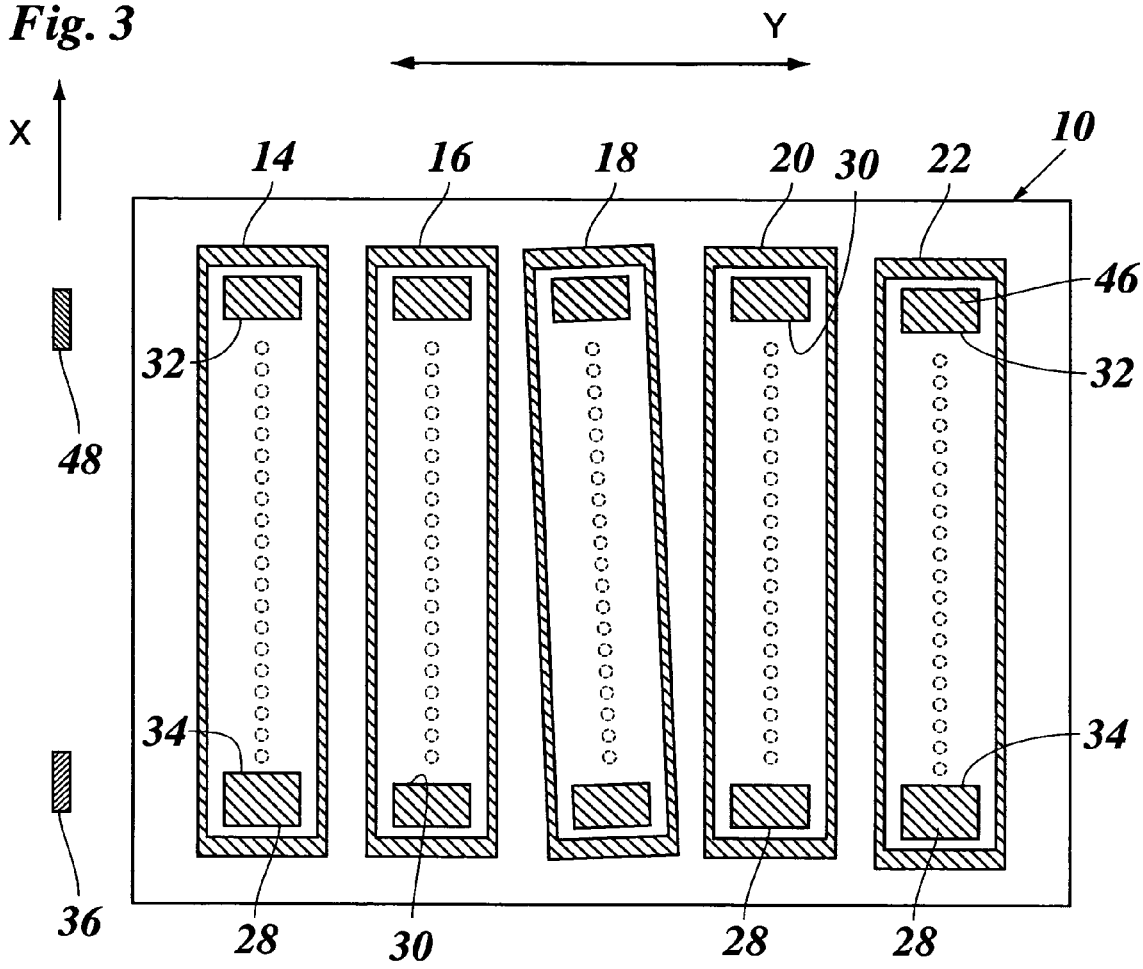
FIG. 3 illustrates a printer according to a modified embodiment.
Figure 4:
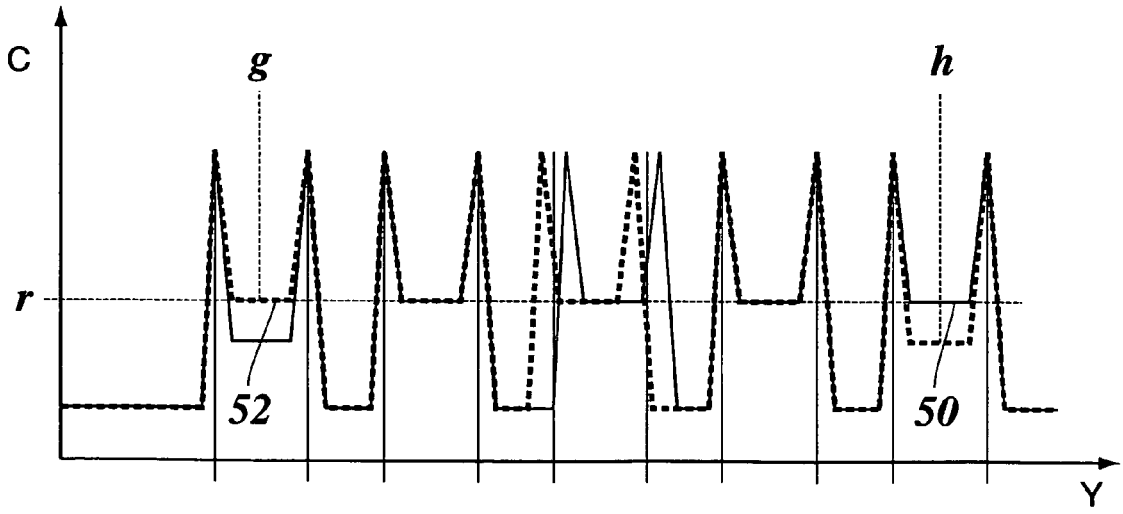
FIG. 4 is a capacitance position-diagram for the printer shown in FIG. 3.

FIGS. 3 and 4 illustrate a modified embodiment, in which the nozzle plates of each of the print heads 14-22 have cutouts 28 and 46 provided at both ends of the rows of nozzles. In addition to the sensor 36, another similar sensor 48 is associated with the cutouts 46.

In the case of the print heads 14 and 22, the cutouts 28 at one end of the nozzle row define straight edges 34, but the height of these cutouts is larger than the height of the other cutouts 28 and 46 having the straight edges 30, 32. The difference in height corresponds exactly to the amount of offset of the print head 22 relative to the other print heads. Thus, the edge 34 of print head 22 is aligned with the edges 30 of the cutouts 28 of the print heads 16, 18 and 20, and for the cutouts 46 at the other end of the print heads, the edge 32 of the print head 14 is aligned with the edges 30 of the print heads 16, 18 and 20.

FIG. 4 shows, in continuous lines, a capacitance curve 50 that is recorded with the sensor 36, and in broken, bold lines, another capacitance curve 52 that is recorded with the sensor 48. In the position "g", the capacitance curve 52 has the same level "r" as for the print heads 16, 18 and 20, which shows that the print head 14 is correctly aligned with the print heads 16-20. On the other hand, in the position "h" in FIG. 4, it is the capacitance curve 50 that has the level "r", which shows that the print head 22 has the correct offset.

Moreover, as has been shown exaggeratedly in FIG. 3, the print head 18 is somewhat tilted relative to the correct position. This type of misalignment is also indicated by the capacitance curves 50 and 51, because the corresponding peaks of the capacitance curve 50 are shifted to the right, whereas the peaks of the capacitance curve 52 are shifted to the left, relative to their respective target positions. Thus, the embodiment according to FIGS. 3 and 4 also permits the detection of a possible misalignment of the nozzle row of a print head relative to the sub-scanning direction.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A method of detecting the alignment of print heads relative to one another in an ink jet printer having a plurality of print heads arranged side by side on a carriage in a first direction (Y), each print head having a conductive nozzle plate which defines an edge that extends in said first direction (Y), wherein a sensor is used for determining the position of a reference mark formed on the print head, said sensor being used to measure a capacitance between the nozzle plate serving as the reference mark, and the sensor, said alignment detection comprising the steps of moving the carriage relative to the sensor in said first direction (Y) into a first position ("b") where said sensor extends across said edge of one print head, and into a second position ("d") where said sensor extends across the edge of another print head, measuring the capacitances in said first and second positions, and comparing the measured capacitances, thereby determining the relative position of said print heads in a second direction (X) orthogonal to said first direction (Y).

2. The method according to claim 1, for a printer having at least one print head that is offset relative to another print head in said second direction (X), wherein the conductive nozzle plate of at least one of said print heads defines a first edge and a second edge arranged in accordance with said offset, and independent first and second capacitance measurements are performed for said first and second edges of said one print head, and the results thereof are compared to the result of the capacitance measurement for the other print head.

3. The method according to claim 2, wherein said first and second capacitance measurements are performed successively with the same sensor.

4. The method according to claim 2, wherein capacitance measurements for said first and second edges are performed with different sensors.

5. The method according to claim 1, wherein the nozzle plate of each print head has at least one edge extending in a second direction (X) orthogonal to said first direction (Y), the method comprising the steps of moving the carriage past said sensor, and recording the measured capacitances as a function of the position of the carriage in said first direction (Y), thereby determining the positions of the print heads relative to one another in said first direction (Y).

6. The method according claim 1, wherein each print head has a plurality of print elements arranged in a row that forms a predetermined angle with said first direction (Y), the nozzle plate of said print head defining, at both ends of said row, at least one edge that extends in a second direction (X) orthogonal to said first direction (Y), said method comprising the steps of moving the carriage past two sensors for detecting the edges at both ends of the row of print elements, recording the capacitances measured with each of said sensors as a function of the position of the carriage in said first direction (Y), and comparing the capacitances recorded with the first sensor to those recorded with the second sensor, thereby determining an inclination of said row of print elements relative to said first direction (Y).

7. An ink jet printer comprising a plurality of print heads arranged side-by-side in a first direction (Y) on a carriage that is movable in said first direction (Y), each print head having a conductive nozzle plate which defines an edge that extends in said first direction (Y), a detection system for detecting the alignment of the print heads relative to one another, the detection system including a capacitance sensor relative to which the carriage is movable in said first direction (Y), and a capacitance measuring circuit adapted to measure a capacitance between the nozzle plate and the sensor when the sensor is in a first position ("b") where said sensor extends across said edge of one of the print heads, and when the sensor is in a second position ("d") where said sensor extends across the edge of another print head, and comparing the measured capacitances, whereby the relative position of the print heads is determined.

8. The printer according to claim 7, wherein said capacitance measuring circuit is detachably connected to the printer.

9. The printer according to claim 7, wherein the conductive plate defines at least one cutout disposed to be scanned by said sensor.

10. The printer according to claim 9, containing at least two print heads arranged side-by-side in a first direction (Y) and offset relative to one another in a second direction (X) orthogonal to said first direction (Y), wherein said at least one cutout in the nozzle plate of at least one print head defines two parallel edges, the positions of which in said second direction (X) represent the offset between said print heads.

* * * * *